US009516703B1

(12) United States Patent
Nelson et al.

(10) Patent No.: US 9,516,703 B1
(45) Date of Patent: Dec. 6, 2016

(54) MAGNETIC HEAT GENERATION AND TRANSFER ASSEMBLY

(71) Applicants: Robert Lynn Nelson, Cudjoe Key, FL (US); Gerald P. Willer, Bismarck, ND (US)

(72) Inventors: Robert Lynn Nelson, Cudjoe Key, FL (US); Gerald P. Willer, Bismarck, ND (US)

( * ) Notice: Subject to any disclaimer, the term of this patent is extended or adjusted under 35 U.S.C. 154(b) by 0 days.

(21) Appl. No.: 14/583,949

(22) Filed: Dec. 29, 2014

(51) Int. Cl.
*H05B 6/10* (2006.01)
*H05B 1/02* (2006.01)

(52) U.S. Cl.
CPC ..... *H05B 6/109* (2013.01); *H05B 1/0297* (2013.01); *H05B 6/108* (2013.01)

(58) Field of Classification Search
CPC ..... H05B 6/108; H05B 6/109; Y10T 403/32606; Y10T 403/32861; Y10T 403/32951
See application file for complete search history.

(56) References Cited

U.S. PATENT DOCUMENTS

| | | | | |
|---|---|---|---|---|
| 4,881,843 | A * | 11/1989 | Randleman | A63H 17/262 403/161 |
| 5,853,283 | A * | 12/1998 | Grant | B60P 3/125 212/261 |
| 8,373,103 | B2 * | 2/2013 | Waldner | F02M 27/045 219/600 |
| 2005/0263522 | A1 * | 12/2005 | Lunneborg | H05B 6/108 219/672 |
| 2010/0209180 | A1 * | 8/2010 | Hasselbusch | F16J 15/344 403/150 |
| 2014/0231414 | A1 * | 8/2014 | Nelson | H05B 6/109 219/628 |

* cited by examiner

*Primary Examiner* — Tu B Hoang
*Assistant Examiner* — Erin McGrath
(74) *Attorney, Agent, or Firm* — Dave Alan Lingbeck

(57) ABSTRACT

A magnetic heat generation and transfer assembly for generating transferable usable heat. The magnetic heat generation and transfer assembly includes a base with first and second elongate support base members spaced apart; an air mover assembly mounted to the base and including a power source with a rotatable drive shaft and also including disc members spaced apart and attached to the rotatable shaft for rotation therewith; and a heat generating assembly mounted to the base and including pivotable elongate magnet supports and magnetic members attached to the elongate magnet supports for generating eddy currents resulting in heat generation.

1 Claim, 5 Drawing Sheets

MAGNETIC HEAT GENERATION AND TRANSFER ASSEMBLY

BACKGROUND OF THE INVENTION

Field of the Invention

The present invention relates to heat generators and more particularly pertains to a new magnetic heat generation and transfer assembly for generating transferable usable heat.

Description of the Prior Art

The use of heat generators is known in the prior art. More specifically, heat generators heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a magnetic heater having a conductor assembly and a magnet assembly. The magnet assembly is adapted to rotate relative to the conductor assembly about an axis so as to induce eddy currents in the conductor assembly when relative motion is produced between the conductor assembly and first magnet assembly. The conductor assembly defines a fluid path therein for the transfer of heat from the conductor assembly to a fluid. The magnetic heater is a component of a heat generation system comprising an internal combustion engine having a drive shaft for rotating the magnet assembly. The heat generated by the magnetic heater, as well as the heat generated by the engine from the engine exhaust and engine cooling system, is combined to heat a fluid. Another prior includes a magnetic heater having a conductive member and a first magnet assembly comprising a frame and at least one magnet disposed a distance adjacent the conductive member, wherein the first magnet assembly and the first frame are adapted to rotate relative to each other about an axis so as to induce eddy currents in the conductive member when relative motion is produced between the conductive member and the first magnet assembly, the at least one magnet adapted to move relative to the frame in dependence on the change in the rate of rotation of the frame. The magnetic heater is provided with a passive relative-positioning actuator adapted to move one or more magnets in an axial direction and a radial direction relative to the frame. Such movement is exploited to control the magnetic field strength at the conductive member by controlling, among other things, the conductor/magnet spacing. While these devices fulfill their respective, particular objectives and requirements, the aforementioned patents do not disclose a new magnetic heat generation and transfer assembly.

SUMMARY OF THE INVENTION

The general purpose of the present invention, which will be described subsequently in greater detail, is to provide a new magnetic heat generation and transfer assembly which has many of the advantages of the heat generators mentioned heretofore and many novel features that result in a new magnetic heat generation and transfer assembly which is not anticipated, rendered obvious, suggested, or even implied by any of the prior art heat generators, either alone or in any combination thereof. The present invention includes a base with first and second elongate support base members spaced apart; an air mover assembly mounted to the base and including a power source with a rotatable drive shaft and also including disc members spaced apart and attached to the rotatable shaft for rotation therewith; and a heat generating assembly mounted to the base and including pivotable elongate magnet supports and magnetic members attached to the elongate magnet supports for generating eddy currents resulting in heat generation. None of the prior art includes the combination of the elements of the present invention.

There has thus been outlined, rather broadly, the more important features of the magnetic heat generation and transfer assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the assemblys of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new magnetic heat generation and transfer assembly which has many of the advantages of the heat generators mentioned heretofore and many novel features that result in a new magnetic heat generation and transfer assembly which is not anticipated, rendered obvious, suggested, or even implied by any of the prior art heat generators, either alone or in any combination thereof.

Still another object of the present invention is to provide a new magnetic heat generation and transfer assembly for generating transferable usable heat.

Still yet another object of the present invention is to provide a new magnetic heat generation and transfer assembly that is monitored with sensors and a fan is used to transfer the generated heat through conduits.

Even still another object of the present invention is to provide a new magnetic heat generation and transfer assembly that automatically controls the spacing of the magnets to the conductors to effectuate maximum efficient heat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
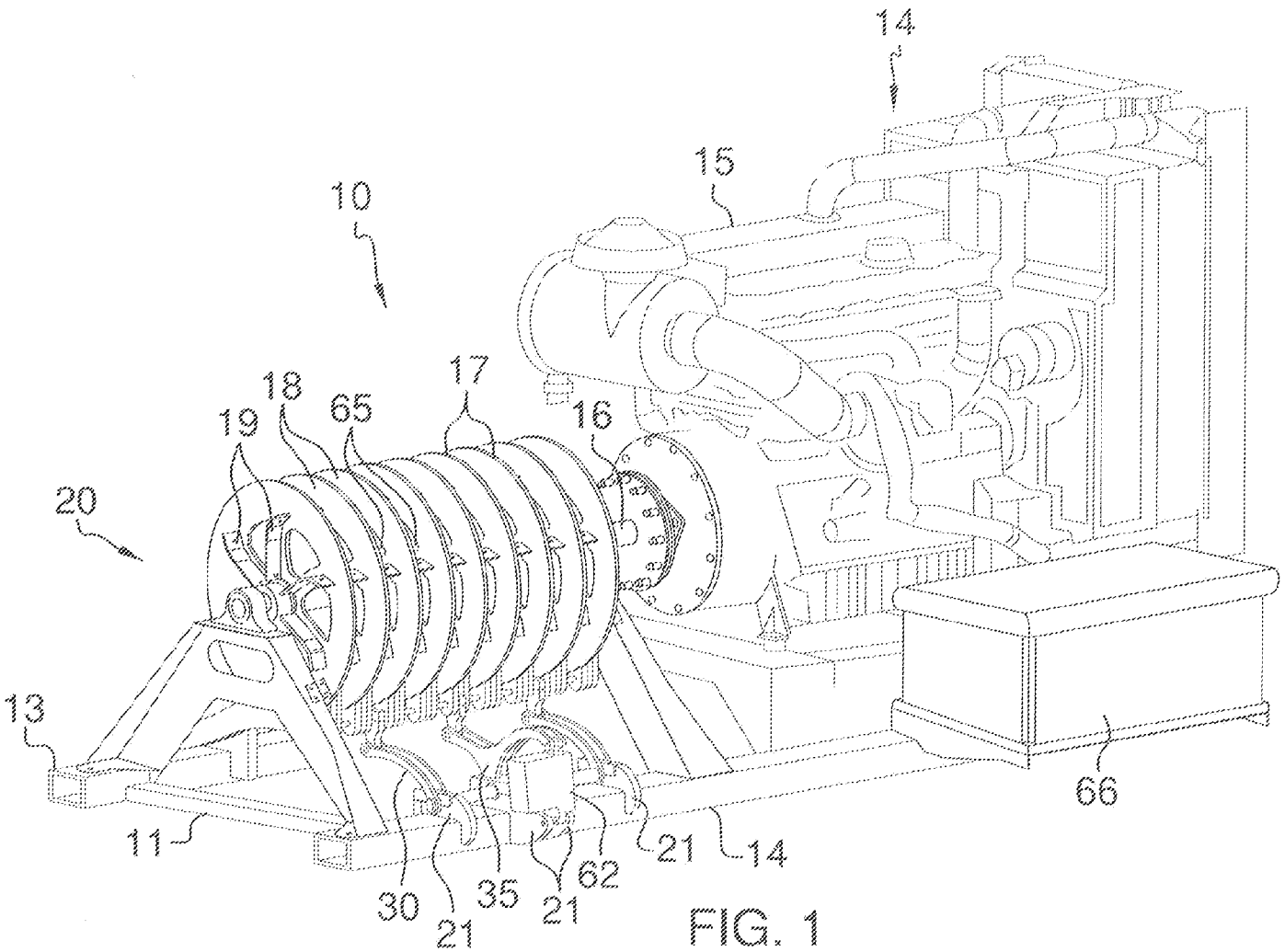
FIG. 1 is a perspective view of a new magnetic heat generation and transfer assembly.

With reference now to the drawings, and in particular to FIGS. 1 through 5 thereof, a new magnetic heat generation and transfer assembly embodying the principles and concepts of the present invention and generally designated by the reference numeral 10 will be described.

As best illustrated in FIGS. 1 through 5, the magnetic heat generation and transfer assembly 10 may generally comprise a base 11 with first and second elongate support base members 12, 13 spaced apart and may also comprise an air mover assembly 14 conventionally mounted to the base 11 and including a power source 15 with a rotatable drive shaft 16 and also including disc members 17 spaced apart and conventionally attached to the rotatable drive shaft 16 for rotation therewith; and, and may further comprise a heat generating assembly 20 conventionally mounted to the base 11 and including pivotable elongate magnet supports 44 and magnetic members 60 conventionally attached to the elongate magnet supports 44 for generating eddy currents resulting in heat generation.

Figure 2:
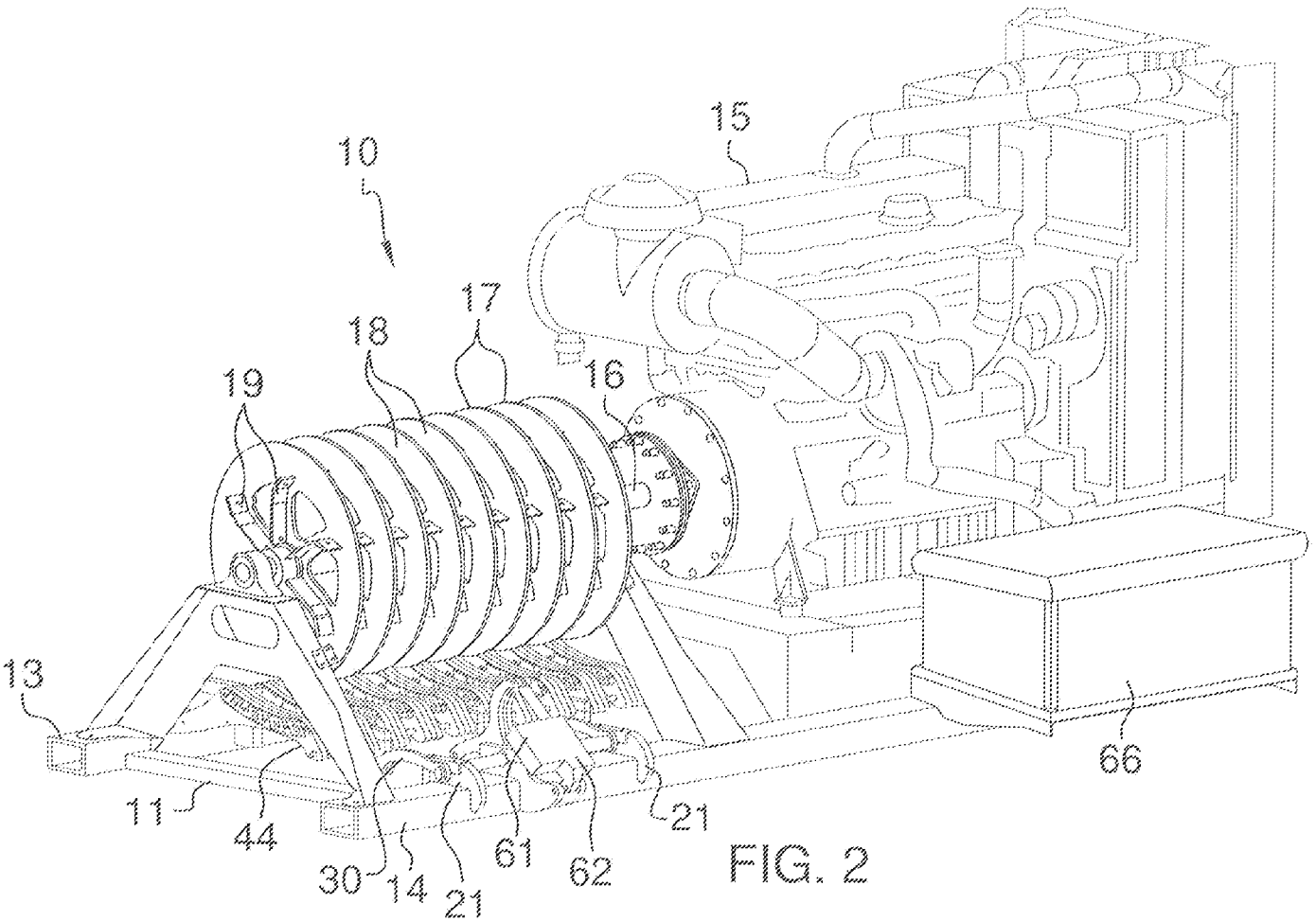
FIG. 2 is another perspective view of the present invention.
Figure 3:
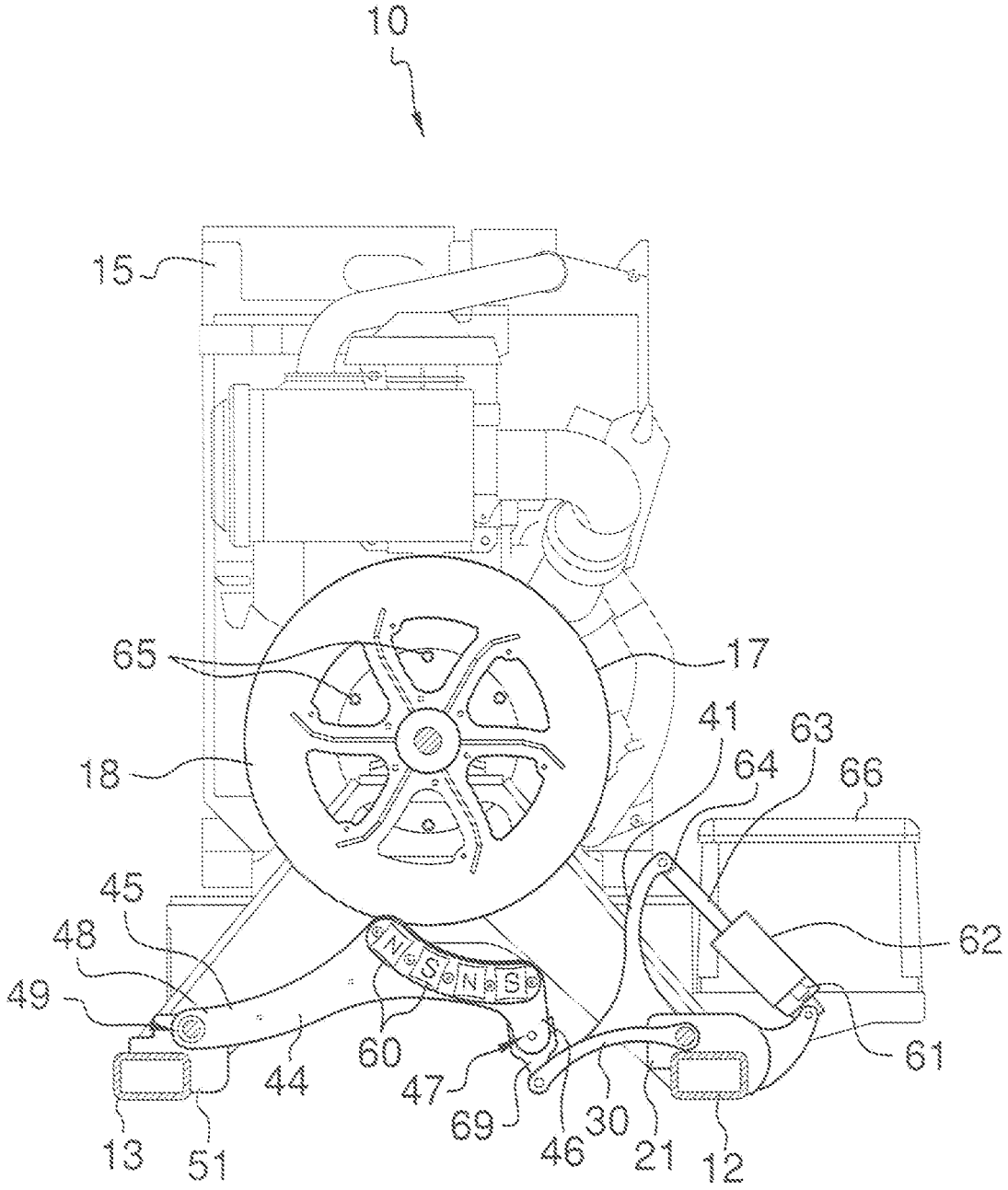
FIG. 3 is an end cross sectional view of the present invention.
Figure 4:
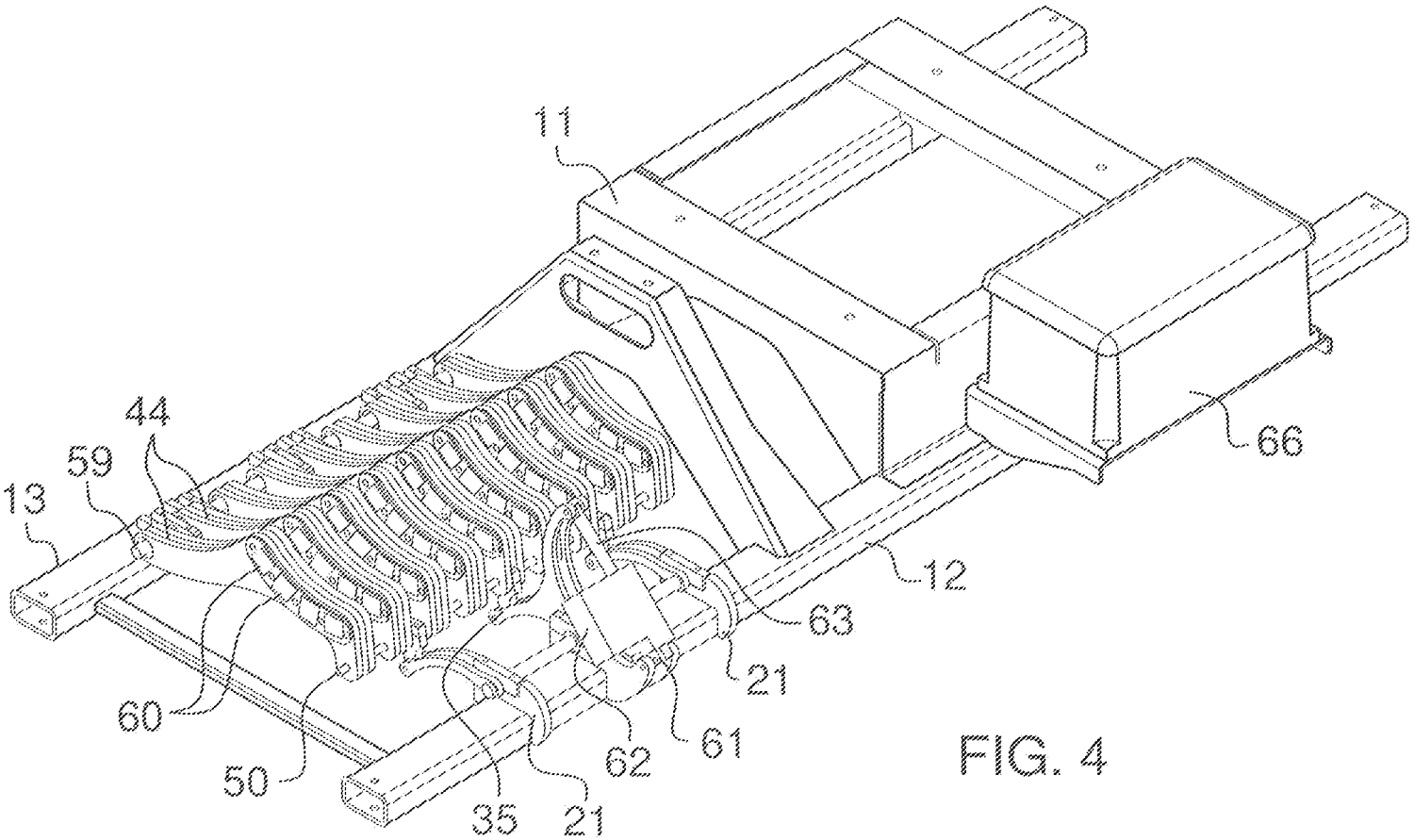
FIG. 4 is a perspective view of the base and heat generating assembly of the present invention.
Figure 5:
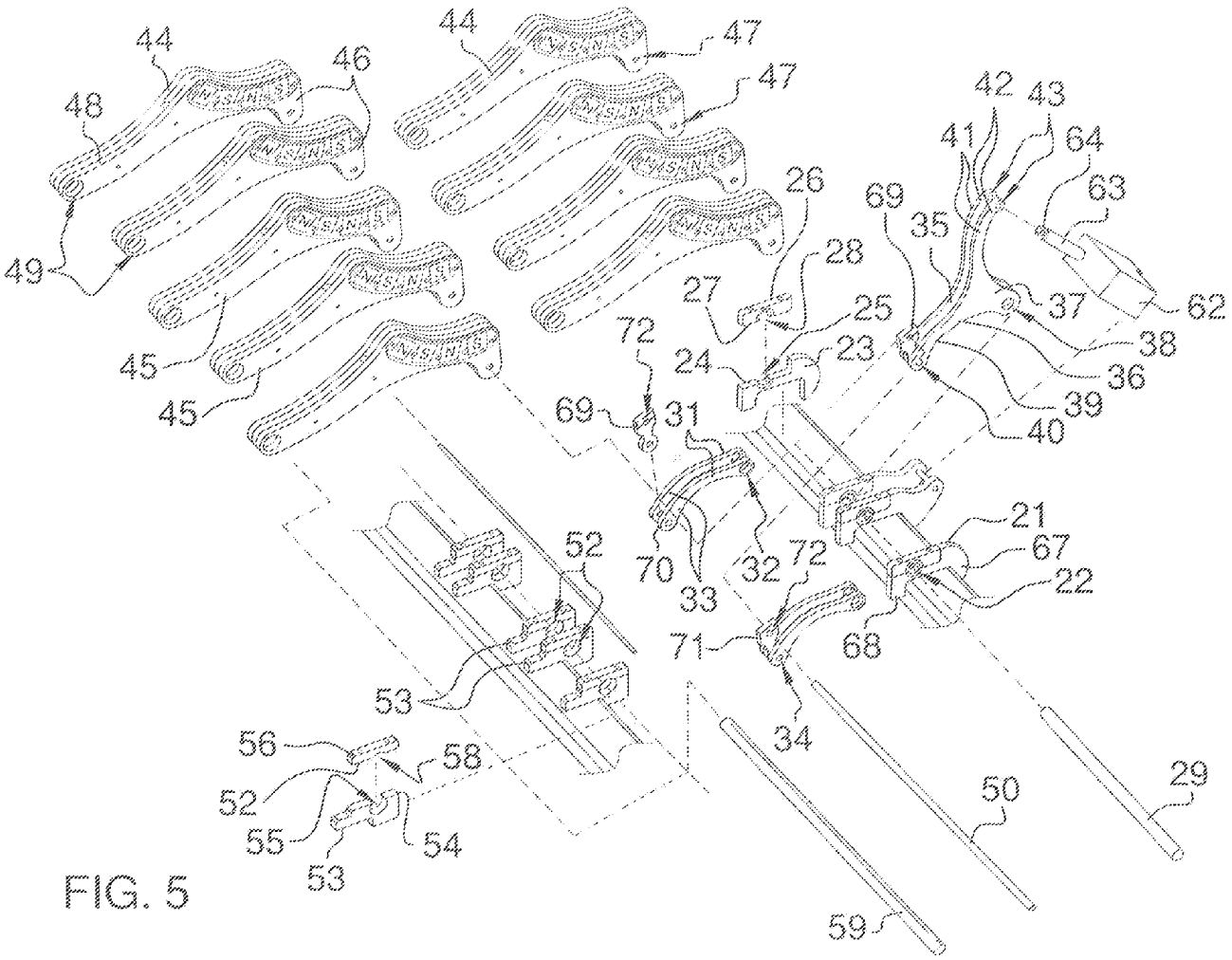
FIG. 5 is an exploded perspective view of the base and the heat generating assembly of the present invention.

As shown in FIGS. 1-3, the disc members 17 may be axially aligned with one another along a length of the drive shaft 16. The planar sides 18 of the disc members 17 may be arranged parallel to one another. The air mover assembly 14 may further include blades 19 conventionally attached to at least one of the opposed sides 18 of each of the disc members 17 to form fan units.

As shown in FIGS. 2-5, the heat generating assembly 20 may also include support brackets 21 conventionally secured to and clamped about and spaced along the first elongate support base member 12 adjacent to the elongate magnet supports 44 with each of the support brackets 21 having an opening 22 extending laterally therethrough. Each of the support brackets 21 may include a solid securement piece 23 such as a block conventionally clamped about the first elongate support base member 12 and having a top side 24 with a slot 25 disposed in the top side 24, and may also have first and second end portions 67, 68 conventionally secured about a portion of the first elongate support base member 12. Each of the support brackets 21 may also include a solid closure piece 26 such as a block having a bottom side 27 and a slot 28 disposed in the bottom side 27 with the closure piece 26 fastenable with conventional fasteners to the securement piece 23 and with the slots 25, 28 of the securement piece 23 and closure piece 26 aligned to form the opening 22. The heat generating assembly 20 may further include a rotatable arm support shaft 29 journaled through the opening 22 of each of the support brackets 21. The heat generating assembly 20 may also include pivotable arm members 30 each having a proximate end 31 with a first hole 32 extending laterally therethrough with the arm support shaft 29 extending through the first hole 32. Each of the pivotable arm members 30 may also have a distal end 33 with a second hole 34 extending laterally therethrough. The heat generating assembly 20 may further include pivotable forked arms 35 each including a main portion 36 having a proximate end 37 with a first hole 38 extending laterally therethrough with the rotatable arm support shaft 29 extending through the first hole 38. The main portion 36 may also have a distal end 39 with a second hole 40 extending laterally therethrough. Each of the forked arms 35 may also have a branch portion 41 angled relative to the main portion 36 and having a distal end 42 with a third hole 43 extending laterally therethrough.

As shown in FIGS. 2-5, the heat generating assembly 20 may also include linkages 69 each having a first end 70 pivotably connected with a conventional fastener at the second hole 34, 40 of a respective arm member 30 and forked arm 35. Each of the linkages 69 may also have a second end 71 with a hole 72 disposed laterally therethrough. Each of the elongate magnet supports 44 may have opposed planar sides 45 and have a proximate end portion 46 with a first opening 47 disposed laterally therethrough, and also has a distal end portion 48 with a second opening 49 disposed laterally therethrough. The planar sides 45 of the elongate magnet supports 44 may be arranged parallel to one another. The heat generating assembly 20 may further include a connecting shaft 50 disposed through the first opening 47 of each of the proximate end portions 46 of the elongate magnet supports 44 and through the hole 72 of each of the second ends 71 of the linkages 69. The heat generating assembly 20 may also include bracket members 51 conventionally secured with fasteners to and spaced along the second elongate support base member 13 adjacent to the elongate magnet supports 44 with each of the bracket members 51 having an opening 52 extending laterally therethrough. Each of the bracket members 51 may include a solid base piece 53 such as a block conventionally secured with fasteners to the second elongate support base member 13 and having a top side 54 with a slot 55 disposed in the top side 54. Each of the bracket members 51 may also include a solid cap piece 56 having a bottom side 57 and a slot 58 disposed in the bottom side 57 with the cap piece 56 fastenable with fasteners to the base piece 53 and with the slots 55, 58 of the base piece 53 and cap piece 56 aligned to form the opening 52 through each of the bracket members 51. The heat generating assembly 20 may further include a support shaft 59 extending through the opening 52 of each of the bracket members 51 and through the second opening 49 of each of the elongate magnet supports 44.

As shown in FIGS. 1 & 2, the elongate magnet supports 44 adjacent to one another are movably and adjustably positionable to either side 18 of a respective said rotatable disc member 17. The magnetic members 60 on one of the elongate magnet supports 44 may have magnetic poles opposite to that of the magnetic members 60 on the adjacent elongate support member 13 thus generating magnetic fields and eddy currents in a space between the adjacent elongate magnet supports 44 and through which the respective disc member 17 rotates and is heated. The magnetic members 60 may be conventionally attached to and spaced upon the planar sides 45 of and along a length of each of the elongate magnet supports 44.

As shown in FIGS. 1-5, the heat generating assembly 20 may further include an actuator 61 in conventional communication with the forked arms 35 for pivoting the elongate magnet supports 44 and moving the magnetic members 60 relative to the respective disc members 17 as desired. The actuator 61 includes a hydraulic control unit 62 and a hydraulic shaft 63 in conventional communication with the hydraulic control unit 62. The hydraulic shaft 63 may have a distal end 64 conventionally connected to the distal end 42 of each of the branch portions 41 of the forked arms 35 to pivot the arm members 30 and the elongate magnet supports 44 and to position the magnetic members 60 relative to the disc members 17 with the magnetic members 60 either moved away from the sides 18 of the disc members 17 to not heat the disc members 17 or moved to the sides 18 of the disc members 17 to heat the disc members 17 with the eddy currents.

As shown in FIG. 3, the magnetic heat generation and transfer assembly 10 may further include sensors 65 conventionally disposed proximate to the heat generating assembly 20 and in conventional communication with the drive shaft 16 to detect heat generation and rotational speed of the drive shaft 16, and may also include a central processing unit 66 in conventional communication with the sensors 65 and with the power source 15 and the actuator 61 to control the positioning of the magnetic members 60 relative to the disc members 17 and to control the rotational speed of the drive shaft 16.

In use, the magnetic members 60 are positioned relative to the disc members 17 using the actuator 61 and the central processing unit 66. To generate heat, the magnetic members 60 are moved in close proximity to the rotatable disc members 17 to create magnetic fields in spaces between adjacent elongate magnet supports 44 with the eddy currents being created from the magnetic fields and heating the disc members 17 as the disc members 17 rotate through the magnetic fields. The elongate magnet supports 44 adjacent to one another are pivoted by the arm members 30 and are moved to opposite sides 18 of the respective rotatable disc members 17 with the respective disc members 17 disposed between the magnetic members 60 on the adjacent elongate magnet supports 44. The eddy currents generated by the opposite magnetic poles of the magnetic members 60 heat the respective disc members 17 as the disc members 17 rotate through the magnetic fields. The central processing unit 66 in cooperation with the sensors 65 controls the positioning of the magnetic members 60 in relationship to the disc members 17. The central processing unit 66 energizes the actuator 61 which pivots the arm members 30 and the elongate magnet supports 44 adjacent to one another. To control the heat and to cool the disc members 17, the central processing unit 66 energizes the actuator 63 to pivot the elongate magnet supports 44 and to move the magnetic members 60 away from opposite sides 18 of the disc members 17 with the disc members 17 not disposed between the magnetic members 60 on the adjacent elongate magnet supports 44.

The heat generated may be transferred and used with air moved by the fan units and with the air moved in relationship to the disc members 17 and the magnetic members 60. As controlled by the central processing unit 66, the disc members 17 and the blades 19 are actuated and rotated by the power source 14 thus causing air to flow about the disc members 17 and the magnetic members 60 to provide a flow of usable heat to and through directional units such as tubes or other ducts or conduits.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the magnetic heat generation and transfer assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A magnetic heat generation and transfer assembly comprising:

a base with first and second elongate support base members spaced apart;

an air mover assembly mounted to the base and including a power source with a rotatable drive shaft and also including disc members spaced apart and attached to the rotatable shaft for rotation therewith; and a heat generating assembly mounted to the base and including pivotable elongate magnet supports and magnetic members attached to the elongate magnet supports for generating eddy currents resulting in heat generation, wherein the heat generating assembly also includes support brackets secured to and spaced along the first elongate support base member adjacent to the elongate magnet supports with each of the support brackets having an opening extending laterally therethrough, wherein the heat generating assembly further includes a rotatable arm support shaft journaled through the opening of each of the support brackets, wherein the heat generating assembly also includes pivotable arm members each having a proximate end with a first hole extending laterally therethrough with the rotatable arm support shaft extending through the first hole, wherein each of the pivotable arm members also has a distal end with a second hole extending laterally therethrough, wherein the heat generating assembly further includes pivotable forked arms spatially arranged parallel to the pivotable arm members and each including a main portion having a proximate end with a first hole extending laterally therethrough with the rotatable arm support shaft extending through the first hole, wherein the main portion also has a distal end with a second hole extending laterally therethrough, wherein each of the forked arms also has a branch portion angled relative to the main portion and having a distal end with a third hole extending laterally therethrough, wherein the heat generating assembly also includes linkages each having a first end pivotably connected at the second hole of a respective said arm member and said forked arm, wherein each of the linkages also has a second end with a hole disposed laterally therethrough, wherein each of the elongate magnet supports has opposed planar sides and has a proximate end portion with a first opening disposed laterally therethrough, and also has a distal end portion with a second opening disposed laterally therethrough, wherein the planar sides of the elongate support members are arranged parallel to one another, wherein the heat generating assembly also includes bracket members secured to and spaced along the second elongate support base member adjacent to the elongate magnet supports with each of the bracket members having an opening extending laterally therethrough, wherein the heat generating assembly further includes a support shaft extending through the opening of each of the bracket members and through the second opening of each of the elongate magnet supports.

* * * * *